US006815883B2

(12) United States Patent
Chow et al.

(10) Patent No.: US 6,815,883 B2
(45) Date of Patent: Nov. 9, 2004

(54) COLD CATHODE FLUORESCENT LAMP WITH A DOUBLE-TUBE CONSTRUCTION

(75) Inventors: Shing Cheung Chow, 1 C/D Young Ya Industrial Bldg., 381-389 Sha Tsui Road., Tsuen Wan (HK); Lap Lee Chow, 1 C/D Young Ya Industrial Bldg., 381-389 Sha Tsui Road., Tsuen Wan (HK)

(73) Assignees: Shing Cheung Chow, N.T. (HK); part Interest; Lap Lee Chow, N.T. (HK); part interest; Dongguan Nam Kwong Electric Co., Ltd., Dongguan Shi (CN); part interest ( * ) Notice: Subject to any disclaimer, the term of this patent is extended or adjusted under 35 U.S.C. 154(b) by 0 days.

(21) Appl. No.: 10/254,852

(22) Filed: Sep. 26, 2002

(65) Prior Publication Data

US 2003/0062822 A1 Apr. 3, 2003

(30) Foreign Application Priority Data

Sep. 29, 2001 (CN) ..... 01141186 A

(51) Int. Cl.[7] ..... H01J 61/34

(52) U.S. Cl. ..... 313/493; 313/483; 313/484; 313/567; 313/573; 313/623

(58) Field of Search ..... 313/17, 39, 43, 313/483, 484, 485, 493, 567, 573, 578, 579, 623, 624, 625, 636, 243, 250, 634, 244

(56) References Cited

U.S. PATENT DOCUMENTS

| | | | | | |
|---|---|---|---|---|---|
| 3,590,306 | A | * | 6/1971 | Burnham et al. | 313/148 |
| 3,662,203 | A | * | 5/1972 | Kuhl et al. | 313/634 |
| 3,758,809 | A | * | 9/1973 | Menelly et al. | 313/491 |
| 5,861,714 | A | * | 1/1999 | Wei et al. | 313/625 |
| 5,962,977 | A | * | 10/1999 | Matsumoto et al. | 313/633 |
| 6,057,635 | A | * | 5/2000 | Nishimura et al. | 313/634 |

* cited by examiner

*Primary Examiner*—Nimeshkumar D. Patel
*Assistant Examiner*—Sharlene Leurig
(74) *Attorney, Agent, or Firm*—Rabin & Berdo, P.C.

(57) ABSTRACT

A cold cathode fluorescent lamp (CCFL) comprises an inner fluorescent tube and an outer glass tube which is sheathed on the outside of said inner tube, characterized in that said inner fluorescent tube and said outer glass tube is separately disposed, and there is a space therebetween. Said CCFL further comprises electrodes sealed at the ends of said inner fluorescent tube and said outer glass tube. The CCFL of the present invention has a double-tube construction, as a result, the inner fluorescent tube is not so much affected by a change in the environmental temperature. Further, the inner fluorescent tube and the outer glass tube are separately disposed so that the end of the inner fluorescent tube and the end of the outer glass tube are not integrally joined, so that a rate of the breakage caused by the temperature difference between two ends is dramatically reduced.

13 Claims, 4 Drawing Sheets

COLD CATHODE FLUORESCENT LAMP WITH A DOUBLE-TUBE CONSTRUCTION

BACKGROUND OF THE INVENTION

1. Field of the Invention

The present invention relates to a gas discharge lamp, more particularly, to a cold cathode fluorescent lamp (CCFL) with a double-tube construction.

2. Description of the Related Art

Cold cathode fluorescent lamps (CCFL) have been widely used in a variety of fields such as liquid crystal displays, scanners, automobile instrument boards, small sized advertising neon signs and picture frame displays because of high luminous intensity, uniform luminous emittance, small-diameter tube and being made in various shapes. Generally, they are a novel miniature high brightness source used as a backlight for the above-mentioned products.

The working voltage of a CCFL depends mainly on the construction and material thereof (e.g., tube diameter, tube length, gas pressure inside, electrode material and construction, process for making the CCFL) as well as the requirements of starting circuit. Therefore, the output power of the CCFL won't vary much as the working voltage increases once it is made. And the output power of the CCFL increases (i.e., an increase in the brightness) as the increase in current, which leads to an increase In the temperature of both electrodes, thereby raising the working temperature of the whole CCFL. If a part of the CCFL is affected by the environment in order to lower the temperature, the brightness of the corresponding portion will be dimmed, thereby resulting in non-uniform brightness of the CCFL. In order to solve this problem, a CCFL with a double-tube construction commercially available (FIG. 1), which comprises an inner fluorescent tube 3, electrodes 1 disposed at both ends of the inner fluorescent tube 3, a layer of fluorescence 5 coated on the internal wall surface of the inner fluorescent tube 3 and a gas 6 filled inside the inner fluorescent tube 3, characterized in that a transparent glass tube 2 is sheathed on the outside of the inner fluorescent tube 3, the space 4 therebetween is either evacuated or filled with a pressured gas, and the end 7 of the outer glass tube 2 is connected in a sealed manner with the end of the inner fluorescent tube 3.

As shown in FIG. 1, at the time that the CCFL is in operation, the inner fluorescent tube 3 is not almost affected by a change in the external temperature and environmental conditions due to that it is separated by the outer glass tube 2, thereby resulting in uniform brightness and stable luminous emission. Even though the environmental temperature is rather low, the inner fluorescent tube 3 can start and reach the required brightness within a very short period of time.

However, in the CCFL shown in FIG. 1, both ends of the inner fluorescent tube 3 are fully embedded into both ends of the outer glass tube 2, i.e., the ends of double tubes are integrally joined. When the environmental temperature becomes lower, the temperature difference between the tubes may reach over 100 degrees Celsius. The stress produced by the temperature difference therebetween may easily cause a break at the sealing ends so that the CCFL becomes useless. Therefore, this CCFL has inherent disadvantages which significantly limits its application prospects in various environments.

SUMMARY OF THE INVENTION

The present invention has been made to solve the above-mentioned technical problems and to overcome disadvantages of the related art. Accordingly, the object of the present invention is to provide a CCFL capable of operating safely and reliably suitably for using in various environments.

According to this invention, a CCFL is provided which comprises an inner fluorescent tube and an outer glass tube sheathed on the outside of the inner fluorescent tube, both of which are separately disposed and there is a space therebetween. Said CCFL also comprises electrodes sealed at the ends of the said inner fluorescent tube and the said outer glass tube.

According to the CCFL of this invention, the external surfaces of the ends of said inner fluorescent tube are connected in a seal manner with the internal surfaces of the ends of said outer glass tube.

According to the CCFL of this invention, the internal surfaces of the ends of said outer glass come into contact with the curved rounded portion of the external surfaces of the ends of said inner fluorescent tube.

According to the CCFL of this invention, the internal surfaces of the ends of said outer glass tube are not in contact with the external surfaces of the ends of the said inner fluorescent tube.

According to the CCFL of this invention, an expandable portion is built on at least one electrode located between the ends of said inner and outer tubes.

The CCFL in accordance with the present invention is provided with the double-tube construction. Due to using such a construction, the inner fluorescent tube is not almost affected by a change in the environmental temperature. Also, as the inner fluorescent tube and the outer glass tube are fully and separately disposed, the ends of double tubes are not integrally joined, thereby reducing significantly the rate of breakage due to a great temperature difference between the ends of double tubes. Furthermore, an expandable portion, which is built on the electrodes sealed between the ends of the inner fluorescent tube and the outer glass tube, can absorb completely the stress caused by the temperature difference therebetween, thereby eliminating breaking of the CCFL.

DETAILED DESCRIPTION OF THE INVENTION

Figure 1:
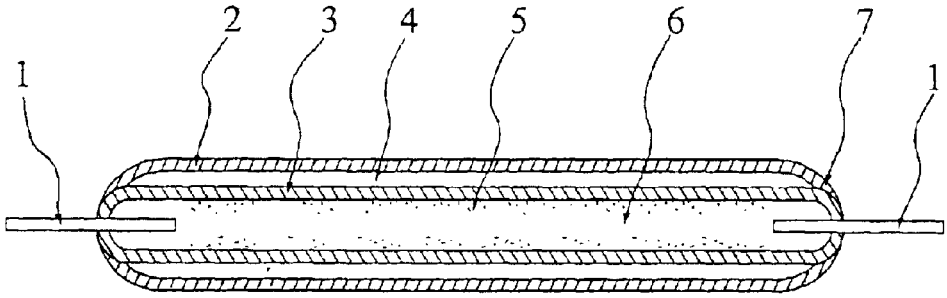
PRIOR ART FIG. 1
FIG. 1 is a schematic sectional view of the fluorescent tube with the double construction according to the prior art.
Figure 2:
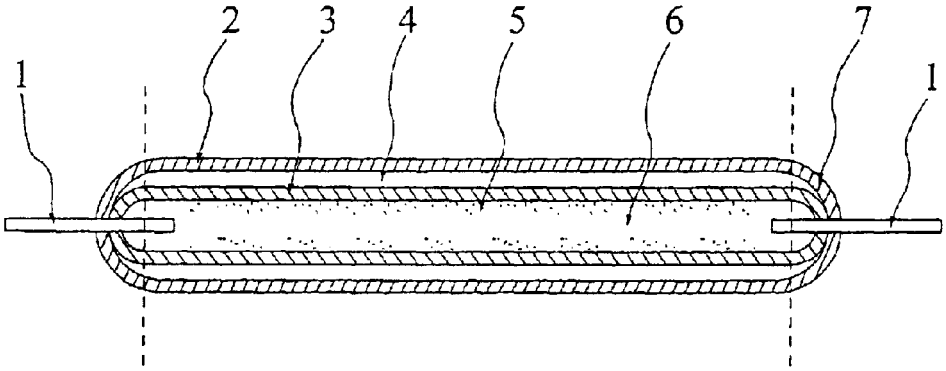
FIG. 2 is a schematic sectional view of the CCFL showing the first example of this invention.

FIG. 2 is a schematic sectional view of the CCFL showing the first example of this invention. In contrast to the CCFL shown in FIG. 1, the ends of the inner fluorescent tube 3 and the outer glass tube 2 of the present invention are not integrally joined, while both are separately disposed. The end of the inner fluorescent tube 3 comes into contact with the end of the outer glass tube 2 through their two opposite surfaces only and both are sealed together, in other words, the internal surface of the end of the outer glass tube 2 merely comes into contact with the curved rounded portion of the external surface of the end of the inner fluorescent tube 3. Compared with the CCFL illustrated in FIG. 1, the contact area of the inner fluorescent tube 3 end and the outer glass tube 2 end is relatively small and such a contact is shallow. As a result, the stress caused by the temperature difference between double tubes is greatly reduced, thereby reducing significantly the broken risk of the CCFL.

Figure 3:
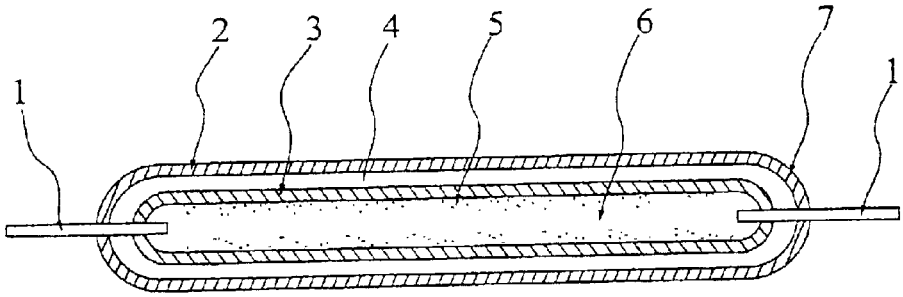
FIG. 3 is a schematic sectional view of the CCFL showing the second example of this invention.

In order to further decrease the impact of the temperature difference between the inner and outer tubes, glass tubes with different expansion coefficients may be used for making an inner fluorescent tube 3 and an outer glass tube 2 respectively. As the inner fluorescent tube 3 will be exposed to around 100 degrees Celsius in operation, glass with low expansion coefficient, such as high borosilicate glass with expansion coefficient of $3.2\times10^{-6}/°$ C., may be used. The temperature of the outer glass tube is low, which is close to the environmental temperature, so glass with high expansion coefficient, such as borosilicate glass with expansion coefficient of $4.0\times10^{-6}/°$ C., may be used. Thus, when the CCFL is in operation, the stress caused by the temperature difference between the inner and outer tubes may be reduced due to double tubes having different expansion coefficients, thereby further reducing the broken risk of the CCFL. Such a strategy that glasses with different coefficients are used for making double tubes is also applicable to the CCFLs shown in FIG. 1 and FIGS. 3 to 6. When applied in the CCFL in FIG. 1, the rate of the breakage of the CCFL may drop from ~60% to ~30%. FIG. 3 is a schematic sectional view of the CCFL showing the second example of this invention. As can be seen in FIG. 3, the ends of the inner and outer tubes 2 and 3 are not directly connected in a sealed manner, while double tubes are in a separate position only by sharing the same electrode 1 at the ends of double tubes. Thus, the ends of the inner and outer tubes will not come into direct contact with each other, that is to say the internal surface of the end of the outer glass tube will not be in contact with the external surface of the end of the inner fluorescent tube. Also, there is a vacuum insulation between double tubes. As a result, when the CCFL is in operation, the temperature difference between double tubes will have no effect on the ends of double tubes, thereby decreasing dramatically the rate of the breakage of the CCFL.

Figure 4:
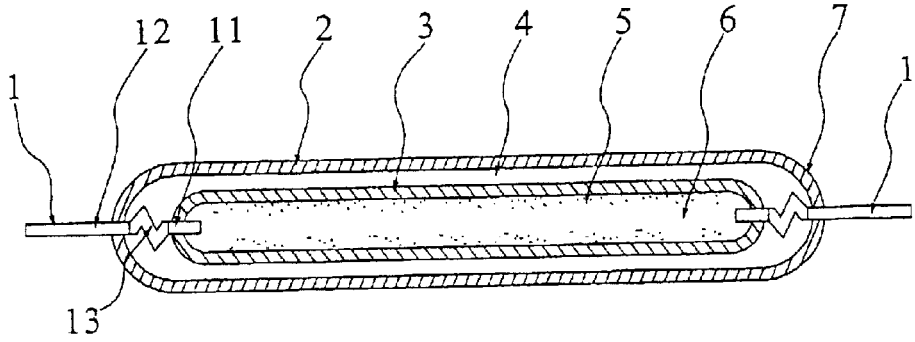
FIG. 4 is a schematic sectional view of the CCFL showing the third example of this invention.

FIG. 4 is a schematic sectional view of the CCFL showing the third example of this invention. As can be seen in FIG. 4, the ends of double tubes are not directly sealed together, but are connected by the electrode 1 disposed at the ends of each of double tubes. For example, the nickel/tungsten electrodes 11 are sealed at both ends of the inner fluorescent tube 3, and the dumet wire electrodes 12 are sealed at both ends of the outer glass tube 2. Both electrodes 11 and 12 are welded together expansively, i.e., an expandable portion 13 (e.g. a bent section) is built on the connection locations of both electrodes. When the CCFL is in operation, an expansion deformation produced by the temperature difference between the inner and outer tubes will be absorbed completely by the above-mentioned expandable portion, thereby ensuring that a break in the CCFL with double tubes caused by such an expansion deformation will not occur. These double tubes may be made of different glasses, for example, borosilicate glass is used for the inner fluorescent tube so that the loss of brightness is reduced and the service life is increased; and glasses, such as soda glass, lead glass (known as soft glass) or kovar glass, are used for the outer glass tube 2. It is possible that other materials can be used for making the electrodes 11 and 12. Regarding the electrodes per se, they can be made of two different kinds of materials or the same material.

Figure 5:
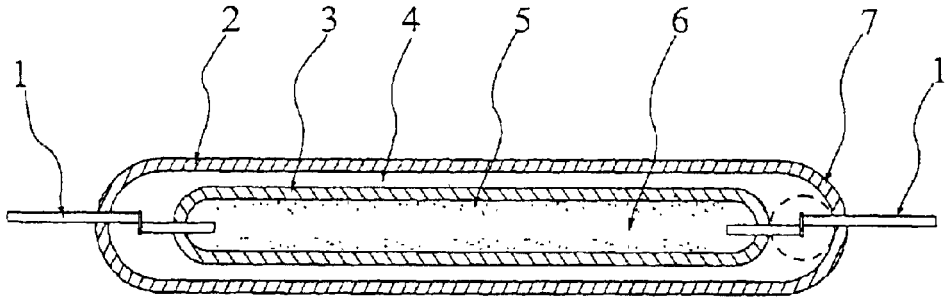
FIG. 5 is a schematic sectional view of the CCFL showing the fourth example of this invention.
Figure 5A:
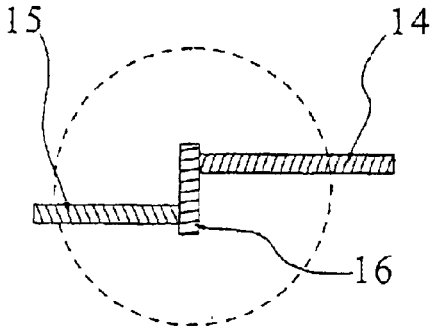
FIG. 5A is a partially enlarged view of the electrodes in FIG. 5 in which the transitional portion has a length direction perpendicular to that of the electrodes.
Figure 5B:
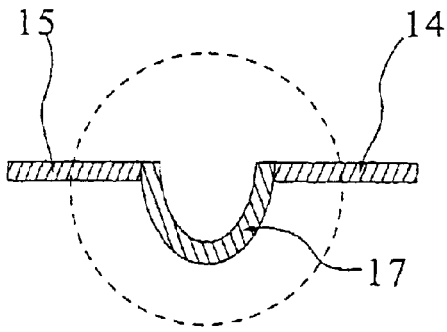
FIG. 5B is a partially enlarged view of the electrodes in FIG. 5 in which the transitional portion is made in an arched form.

FIG. 5 is a schematic sectional view of the CCFL showing the fourth example of this invention. As can be seen in FIG. 5, the ends of double tubes are not directly sealed together, but are connected by the electrode 1 disposed at the ends of double tubes. The expandable portion includes the transitional portions which are built on electrodes located between the ends of the inner and outer tubes 2 and 3. FIGS. 5A and 5B illustrate an enlarged detail of the said electrode. Said electrodes includes tungsten electrodes 14 sealed at the ends of the outer glass tube 2, tungsten electrodes 15 sealed at the ends of the inner fluorescent tube 3, and a transitional portion, such as nickel wire 16 (FIG. 5A), or nickel strip, nickel alloy wire and/or strip 17 (FIG. 5B), which is connected (e.g. welded) between the tungsten electrodes 14 and 15. As a nickel wire or a nickel strip is plastic and soft, and can form an expandable electrode after being connected with the rigid tungsten electrodes by welding, the resulted electrode may absorb completely the expansion deformation caused by the temperature difference between the inner and outer tubes in order to prevent the CCFL from breaking due to the expansion stress and fully to eliminate a damage during operation. Preferably, the nickel wire 16 has a length direction perpendicular to that of the tungsten electrodes 14 and 15, for example, it can be seen in FIG. 5A that the tungsten electrodes 14 and 15 are welded on the upper and lower ends of the nickel wire 16 respectively. Also, the nickel strip 17 can be made in an arched form, for example, as can bee seen in FIG. 5B, the tungsten electrodes 14 and 15 are welded on both ends of the arc-shaped nickel strip 17. The electrode 1 formed in such a manner has sufficient elasticity and buffer action in its length direction. The tungsten electrodes 14 and 15, which are directly sealed at the ends of double tubes, are so rigid and strong that they can support the inner fluorescent tube 3 without any effects on the lighting location of the CCFL and ensuring the uniform brightness thereof.

Figure 6:
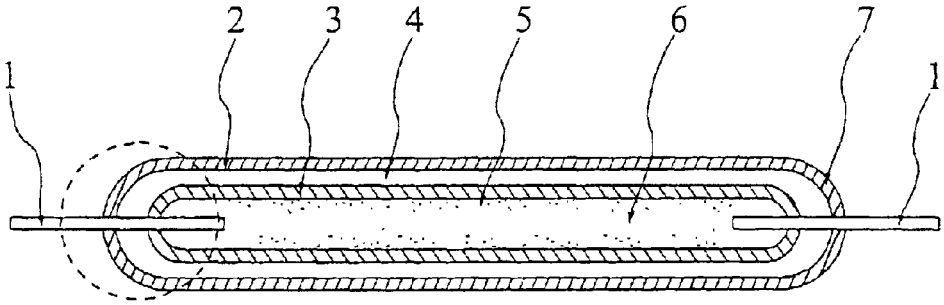
FIG. 6 is a schematic sectional view of the CCFL showing the fifth example of this invention.
Figure 6A:
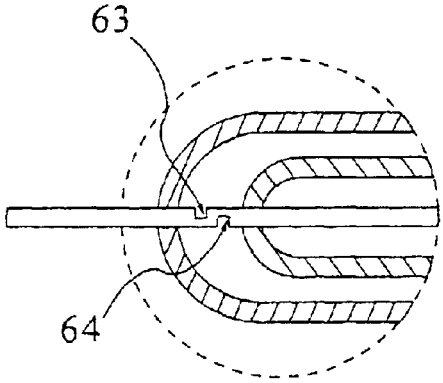
FIG. 6A is a partially enlarged view of the electrode in FIG. 6 in which two notches are alternately formed in a radial direction on two sides of the electrode.

FIG. 6 is a schematic sectional view of the CCFL showing the fifth example of this invention. As can be seen in FIG. 6, the ends of the inner and outer tubes are connected by the electrode 1 disposed at the ends of double tubes. The electrode 1 is a tungsten electrode. FIG. 6A illustrates an enlarged detail of the said electrode, in which at least one notch is formed on said electrode. If two notches 63 and 64 or more are formed, they are in a radial direction of said electrode and are alternately arranged to be on two sides of said electrode. The notch 63 or 64 has a depth of $1/10$~$8/16$ times as great as the diameter of electrode 1, they form an elastic buffer region on the electrode 1 alternately, which can absorb completely the expansion deformation caused by the temperature difference between the inner and outer tubes, thereby avoiding a breakage in the CCFL with double tubes produced by the expansion stress and eliminating a damage of the CCFL in operation. Also, when dumet wire electrode is used as electrode 1, soda glass (i.e. soft glass) may be used for making the tube; while when using kovar electrode or molybdenum electrode, molybdenum glass may be used for making the above-mentioned glass tube. Several examples of the CCFLs according to the present invention will be described as follows.

EXAMPLE 1

As can be seen in FIG. 2, a linear-type CCFL has an inner fluorescent tube 3 which is made of such as borosilicate glass and has an outer diameter of 1.8 mm, a length of 250 mm, an inner wall coated with fluorescent powder with a color temperature of 6500° k, and two ends provided with tungsten electrodes, being filled with a mixture of argon and neon as well as mercury gas inside the tube. It further has an outer glass tube 2 which is made of borosilicate glass and has an outer diameter of 2.6 mm, an inner diameter of 2.0 mm, a length of 255 mm, and two ends sealed on the tungsten electrodes. The space between the double tubes is, for example, 0.1 mm, or the double tubes are in a slight contact, the space therebetween is evacuated to 1–20 pa. A special starting circuit is used for the CCFL at an input voltage of such as 12 V and an input current of such as 0.32 A, the tube current being about 5.0 mA and the tube voltage being about 600 V. This CCFL has a surface luminance of about 40000 cd/$m^2$ and a luminous flux of above 30 Lm. The surface temperature of the inner fluorescent tube 3 is around 70–100° C., and the surface temperature of the outer glass 2 is slightly higher than the environmental temperature.

EXAMPLE 2

A L-shaped CCFL has an inner fluorescent tube 3 which is made of such as borosilicate glass and has an outer diameter of 1.8 mm, a length of 420 mm, an inner wall coated with fluorescent powder with a color temperature of 7000° k, and two ends provided with welded tungsten/nickel electrodes, being filled with a mixture of argon and neon as well as mercury gas inside the tube. It further has an outer glass tube 2 which is made of borosilicate glass and has an outer diameter of 3 mm, an inner diameter of 2.1 mm, a length of 426 mm, and two ends sealed on the tungsten electrodes, as shown in FIG. 3. The space between the double tubes is, for example, 0.15 mm, or the double tubes are in a slight contact, the space therebetween is evacuated to 1–20 pa. A special starting circuit is used for the CCFL at an input voltage of such as 12.5 V and an input current of such as 0.46 A, the tube current being about 7.0 mA and the tube voltage being about 700 V. This CCFL has a surface luminance of about 42000 cd/$m^2$ and a luminous flux of above 170 Lm. The surface temperature of the inner fluorescent tube 3 is around 80–100° C., and the surface temperature of the outer glass 2 is slightly higher than the environmental temperature.

EXAMPLE 3

As can be seen in FIG. 3, a linear-type CCFL has an inner fluorescent tube 3 which is made of such as borosilicate glass (expansion coefficient is $3.2\times10^{-6}$/° C.) and has an outer diameter of 1.8 mm, a length of 140 mm, an inner wall coated with fluorescent powder with a color temperature of 7000° k, and two ends provided with welded tungsten/nickel electrodes, being filled with a mixture of argon and neon as well as mercury gas inside the tube. It further has an outer glass tube 2 which is made of borosilicate glass (expansion coefficient is $4.0\times10^{-6}$/° C.) and has an outer diameter of 3.0 mm, an inner diameter of 2.1 mm, a length of 146 mm, and two ends sealed on the tungsten electrodes. The space between the double tubes is, for example, 0.15 mm, or the double tubes are in a slight contact, the space therebetween is evacuated to 1–20 pa. A special starting circuit is used for the CCFL at an input voltage of such as 13.4 V and an input current of such as 0.19 A, the tube current being about 5.0 mA and the tube voltage being about 370 V. This CCFL has a surface luminance of about 42000 cd/$m^2$ and a luminous flux of above 60 Lm. The surface temperature of the inner fluorescent tube 3 is around 70–100° C., and the surface temperature of the outer glass 2 is slightly higher than the environmental temperature.

EXAMPLE 4

As can be seen in FIG. 4, a linear-type CCFL has an inner fluorescent tube 3 which is made of such as borosilicate glass and has an outer diameter of 1.8 mm, a length of 164 mm, an inner wall coated with fluorescent powder with a color temperature of 6800° k, and two ends provided with welded tungsten/nickel electrodes, being filled with a mixture of argon and neon as well as mercury gas inside the tube. It further has an outer glass tube 2 which is made of kovar glass and has an outer diameter of 2.6 mm, an inner diameter of 2.0 mm, a length of 172 mm, and two ends sealed on the dumet wire electrodes, the electrodes between the ends of the inner and outer tubes being a dumet wire and being in a saw form. The space between the double tubes is, for example, 0.1 mm, or the double tubes are in a slight contact, the space therebetween is evacuated to 1–20 pa. A special starting circuit is used for the CCFL at an input voltage of such as 8.5 V and an input current of such as 0.18 A, the tube current being about 1.5 mA and the tube voltage being about 560 V. This CCFL has a surface luminance of about 22000 cd/$m^2$ and a luminous flux of above 40 Lm. The surface temperature of the inner fluorescent tube 3 is around 70–90° C., and the surface temperature of the outer glass 2 is slightly higher than the environmental temperature.

EXAMPLE 5

As can be seen in FIG. 5, a linear-type CCFL has an inner fluorescent tube 3 which is made of such as borosilicate glass and has an outer diameter of 2.6 mm, a length of 240 mm, an inner wall coated with fluorescent powder with a color temperature of 6300° k, and two ends provided with welded tungsten/nickel electrodes, being filled with a mixture of argon and neon as well as mercury gas inside the tube. It further has an outer glass tube 2 which is made of borosilicate glass and has an outer diameter of 4.0 mm, an inner diameter of 2.9 mm, a length of 250 mm, and two ends sealed on the tungsten electrodes, the electrodes between the ends of the inner and outer tubes being provided with a nickel wire or a nickel strip. The space between the double tubes is, for example, 0.15 mm, or the double tubes are in a slight contact, the space therebetween is evacuated to 1–20 pa. A special starting circuit is used for the CCFL at an input voltage of such as 11.3 V and an input current of such as 0.29 A, the tube current being about 6.0 mA and the tube voltage being about 500 V. This CCFL has a surface luminance of about 36000 cd/$m^2$ and a luminous flux of above 130 Lm. The surface temperature of the inner fluorescent tube 3 is around 80–100° C., and the surface temperature of the outer glass 2 is slightly higher than the environmental temperature.

EXAMPLE 6

As can be seen in FIGS. 6 and 6A, a linear-type CCFL has an inner fluorescent tube 3 which is made of borosilicate glass and has an outer diameter of 1.8 mm, a length of 164 mm, an inner wall coated with fluorescent powder with a color temperature of 6800°k, and two ends provided with tungsten electrodes, being filled with a mixture of argon and neon as well as mercury gas inside the tube. It further has an outer glass tube 2 which is made of borosilicate glass and has an outer diameter of 2.6 mm, an inner diameter of 2.0 mm, a length of 174 mm, and two ends sealed on the tungsten electrodes, on which two notches are disposed, one being opposite to another and both being at an angle of 180°. The space between the double tubes is, for example, 0.1 mm, or the double tubes are in a slight contact, the space therebetween is vacuumed to 1–20 pa. A special starting circuit is used for the CCFL at an input voltage of such as 12 V and an input current of such as 0.23 A, the tube current being about 5.0 mA and the tube voltage being about 420 V. This CCFL has a surface luminance of about 51000 cd/$m^2$ and a luminous flux of above 80 Lm. The surface temperature of the inner fluorescent tube 3 is around 90–100° C., and the surface temperature of the outer glass 2 is slightly higher than the environmental temperature.

The examples and the embodiments of this invention described as above are intended to facilitate the understanding and knowledge of the CCFLs according to the present invention. It would be apparent to those skilled in the art that various changes and modifications may be made therein without departing from the scope of the appended claims, but such changes and modifications should come within the scope of the present invention.

What is claimed is:

1. A miniature cold cathode fluorescent lamp (CCFL), comprising:

an outer glass tube;

an inner fluorescent tube disposed entirely inside of said outer glass tube, said inner fluorescent tube and said outer glass tube being separated from each other;

a first electrode sealed at respective first ends of said inner fluorscent tube and said outer glass tube; and a second electrode sealed at respective second ends of said inner fluorescent tube and said outer glass tube, said inner fluorescent tube being connected to said outer glass tube using only said first and second electrodes.

2. The miniature CCFL as claimed in claim 1, wherein at least said first electrode includes an expandable portion between the first end of said inner fluorescent tube and the first end of said outer glass tube.

3. The miniature CCFL as claimed in claim 2, wherein said expandable portion is a bent section of said first electrode.

4. The miniature CCFL as claimed in claim 2, wherein said expandable portion includes at least two notches disposed in a radial direction of said first electrode and being alternately arranged to be on opposite sides of said first electrode.

5. The miniature CCFL as claimed in claim 4, wherein a depth of said notches is 1/10 to 1/8 times as great as a diameter of said first electrode.

6. The miniature CCFL as claimed in claim 1, wherein said inner fluorescent tube and said outer glass tube are made of glasses having different respective expansion coefficients.

7. The miniature CCFL as claimed in claim 2, wherein said inner fluorescent tube and said outer glass tube are made of glasses having different respective expansion coefficients.

8. The miniature CCFL as claimed in claim 3, wherein said inner fluorescent tube and said outer glass tube are made of glasses having different respective expansion coefficients.

9. The miniature CCFL as claimed in claim 6, wherein said outer glass tube has a greater expansion coefficient than that of said inner fluorescent tube.

10. The miniature CCFL as claimed in claim 1, wherein said inner fluorescent tube and said outer glass tube are made of a same kind of glass.

11. The miniature CCFL as claimed in claim 2, wherein said inner fluorescent tube and said outer glass tube are made of a same kind of glass.

12. The miniature CCFL as claimed in claim 3, wherein said inner fluorescent tube and said outer glass tube are made of a same kind of glass.

13. The miniature CCFL as claimed in claim 1, wherein said outer glass tube has an outer diameter no greater than 4 mm.

* * * * *